United States Patent [19]

White

[11] Patent Number: 5,026,311

[45] Date of Patent: Jun. 25, 1991

[54] ARC TUBE FABRICATION PROCESS

[75] Inventor: Philip J. White, Georgetown, Mass.

[73] Assignee: GTE Products Corporation, Danvers, Mass.

[21] Appl. No.: 611,377

[22] Filed: Nov. 13, 1990

Related U.S. Application Data

[63] Continuation of Ser. No. 277,468, Nov. 23, 1988, abandoned, which is a continuation of Ser. No. 473,896, Mar. 10, 1983, abandoned.

[51] Int. Cl.[5] ..... H01J 9/00

[52] U.S. Cl. ..... 445/26

[58] Field of Search ..... 445/9, 16, 17, 21, 26, 445/40, 41, 43

[56] References Cited

U.S. PATENT DOCUMENTS

| | | | |
|---|---|---|---|
| 3,401,296 | 9/1968 | Rigot | 445/21 |
| 3,628,846 | 12/1971 | Cortorillo | 445/26 |
| 3,642,340 | 2/1972 | Yamane et al. | 445/43 |
| 3,657,589 | 4/1972 | Della Porta | 445/31 |
| 3,726,582 | 4/1973 | Tol et al. | 445/26 |
| 3,986,236 | 10/1976 | Barakitis et al. | 445/26 |
| 4,156,550 | 5/1979 | Furukubo et al. | 445/53 |
| 4,157,485 | 6/1979 | Wesselink et al. | 445/26 |
| 4,308,650 | 1/1982 | Hernandez et al. | 445/26 |
| 4,333,032 | 6/1982 | Wyner et al. | 445/41 |

FOREIGN PATENT DOCUMENTS

| | | | |
|---|---|---|---|
| 0059972 | 5/1977 | Japan | 445/16 |
| 5133732 | 10/1980 | Japan | 445/41 |
| 1211176 | 11/1970 | United Kingdom . | |
| 1211175 | 11/1977 | United Kingdom . | |

*Primary Examiner*—Kurt Rowan

*Attorney, Agent, or Firm*—Thomas H. Buffton; Martha Ann Finnegan

[57] ABSTRACT

A process for fabricating arc tubes for the manufacture of unsaturated vapor high pressure sodium lamps wherein a first electrode is sealed into one end of a ceramic envelope, a sodium-mercury amalgam and an oxygen-absorbing getter are introduced into the ceramic envelope, the ceramic envelope is flushed and then filled with a rare gas, and a second electrode is sealed into the other end of the ceramic envelope to provide an arc tube wherein decomposition of the amalgam and absorption of oxygen occurs within the ceramic envelope during operational use.

7 Claims, 2 Drawing Sheets

ARC TUBE FABRICATION PROCESS

This is a continuation of copending application Ser. No. 07/277,468 filed on Nov. 23, 1988, which is a continuation of parent application Ser. No. 06/473,896, filed Mar. 10, 1983 both now abandoned.

CROSS REFERENCE TO OTHER APPLICATIONS

Concurrently filed applications entitled "Unsaturated Vapor Pressure Type High Pressure Sodium Lamp," bearing U.S. Ser. No. 473,895, and "Unsaturated Vapor High Pressure Sodium Lamp Getter Mounting," bearing U.S. Ser. No. 473,897, relate to an arc tube and an arc tube fabricating process for unsaturated vapor high pressure sodium lamps. Also, concurrently filed applications entitled "Unsaturated Vapor High Pressure Sodium Lamp Arc Tube Fabrication Process," bearing U.S. Ser. No. 473,894, and "Arc Tube Dosing Process For Unsaturated High Pressure Sodium Lamps," bearing U.S. Ser. No. 473,892, relate to tube fabrication and arc tube dosing of unsaturated vapor type high pressure sodium lamps.

TECHNICAL FIELD

This invention relates to the manufacture of high pressure sodium lamps of the unsaturated vapor type and more particularly to a process for fabricating arc tubes for use in high pressure sodium lamps of the unsaturated vapor types.

BACKGROUND ART

In the manufacture of high pressure sodium lamps, it is a normal practice to provide a tubular ceramic arc tube which is supported within an evacuated envelope which is, in turn, affixed to an ordinary screw-in type base member. Usually, the arc tube is filled with an excess amount of sodium in an attempt to compensate for undesired losses thereof during operation of the lamp. Thus, available high pressure sodium lamps are, for the most part, of the so-called saturated vapor type and are known to provide undesired variations in lamp voltage and color rendition because of this saturated condition.

In an effort to eliminate or at least reduce such undesired effects, it has long been known that a lamp wherein the amount of sodium and mercury employed is only that which will become totally vaporized would provide the desired result. In other words, a high pressure sodium lamp of the unsaturated vapor type wherein sodium and mercury are introduced in only such an amount as to become totally vaporized is a highly desirable structure insofar as efficiency, cost of manufacture and enhanced lighting capability are concerned.

However, one of the major problems encountered in the fabrication of unsaturated vapor high pressure sodium lamps is the introduction therein of the proper amounts of sodium and mercury. Since the sodium content is of a relatively small amount and sodium is such a chemically active material, it has been found most difficult to dose or introduce the proper amount thereof into the arc tube of an unsaturated vapor high pressure sodium lamp.

One known suggestion for dosing an arc tube for a high pressure sodium lamp with the proper amount of sodium and mercury is set forth in U.S. Pat. No. 4,156,550, issued to Furukubo et al on May 29, 1979. Therein, sodium azide (NaN3) was dissolved in a solvent, placed in a container and the solvent evaporated. Also, a mercury dispenser in the form of an Al-Zr-Ti-Hg alloy was placed in the container. Thereafter, the container was positioned within one exhaust pipe affixed to the arc tube, and this one exhaust pipe was closed or pinched off. Another exhaust pipe or tube was affixed to the other end of the arc tube and to an exhaust system. The exhaust tube having the container therein was heated to decompose the sodium and mercury-containing compounds and provide the desired sodium and mercury within the arc tube. Also, the arc tube was evacuated and re-filled with a starting gas.

Although the above-described technique may or may not be employed in an unsaturated vapor high pressure sodium lamp fabrication process, it is submitted that the process leaves something to be desired. More specifically, the process appears to be relatively expensive of components, procedural steps and apparatus. For example, the suggested exhaust tubes of niobium are relatively expensive and not readily available in ordinary high pressure sodium lamp manufacturing facilities.

OBJECTS AND SUMMARY OF THE INVENTION

An object of the present invention is to provide an improved high pressure sodium lamp manufacturing process. Another object of the invention is to enhance the fabrication of an arc tube for use in an unsaturated vapor high pressure sodium lamp. A further object of the invention is to reduce the complexity of fabricating an arc tube for an unsaturated high pressure sodium lamp.

These and other objects, advantages and capabilities are achieved in one aspect of the invention by an arc tube fabricating process wherein a first electrode is sealed into one end of a tubular ceramic envelope, a sodium-mercury amalgam and an oxygen-absorbing getter are disposed therein, the envelope is exhausted and then filled with a low pressure noble gas and a second electrode is sealed into the opposite end of the tubular ceramic envelope.

BEST MODE FOR CARRYING OUT THE INVENTION

For a better understanding of the present invention, together with other and further objects, advantages and capabilities thereof, reference is made to the following disclosure and appended claims in connection with the accompanying drawings.

Figure 1:
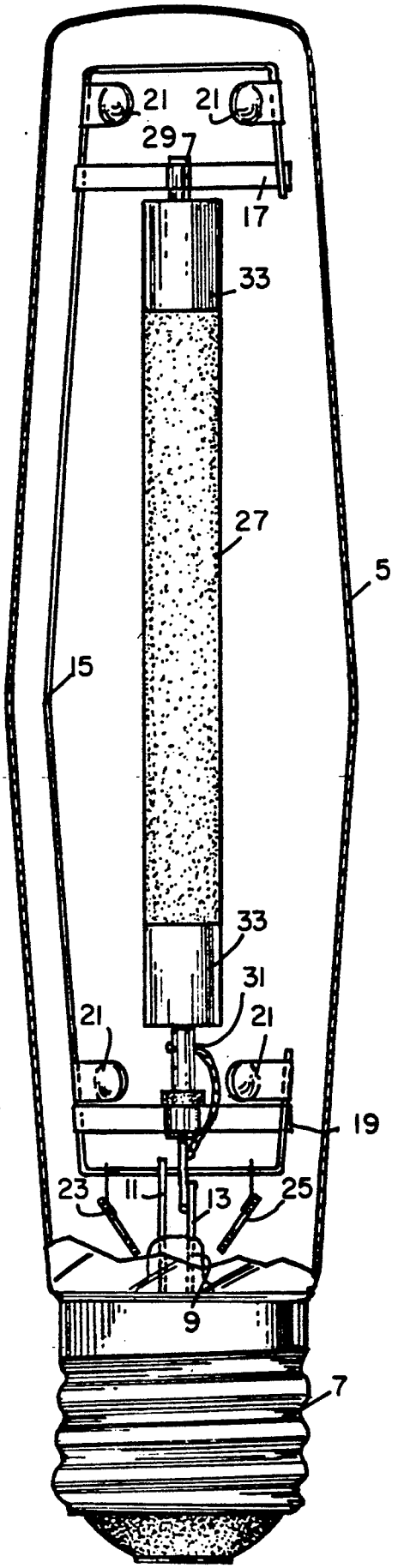
FIG. 1 is an elevational view of an unsaturated vapor high pressure discharge lamp of the invention.

Referring to the drawings, FIG. 1 illustrates an unsaturated vapor high pressure sodium lamp having a hermetically sealed and evacuated glass envelope 5 formed to fit into an ordinary screw-type base member 7. A glass stem member 9 is sealed to the envelope 5 and projects therein. Electrical conductors, 11 and 13 respectively, are sealed into and pass through the stem member 9 to provide electrical connections from the interior to the exterior of the glass envelope 5.

An electrically conductive support member 15 is affixed to one of the electrical conductors 11 and has a pair of crossbars 17 and 19 affixed thereto at either end. Also, a plurality of spring-like members 21 are affixed to the support member 15 and formed for contact with the glass envelope 5. Moreover, a pair of getters 23 and 25 are attached to the support member 15 and serve to insure the integrity of the evacuated envelope 5.

Disposed within the glass envelope 5 and supported by the crossbars 17 and 19 is an arc tube 27. This arc tube 27, preferably of a material such as polycrystalline alumina for example, includes an electrode 29 and 31 at either end thereof. One electrode 29 is affixed to and supported by the crossbar 17 while the other electrode 31 is insulatingly supported by the other crossbar 19, but electrically connected to the electrical conductor 13 passing through the stem member 9. Heat conserving elements 33 may be wrapped about the arc tube 27 at each end thereof in the vicinity of the electrodes 29 and 31 in order to reduce the heat differential thereat from the center of the arc tube 27.

Figure 2:
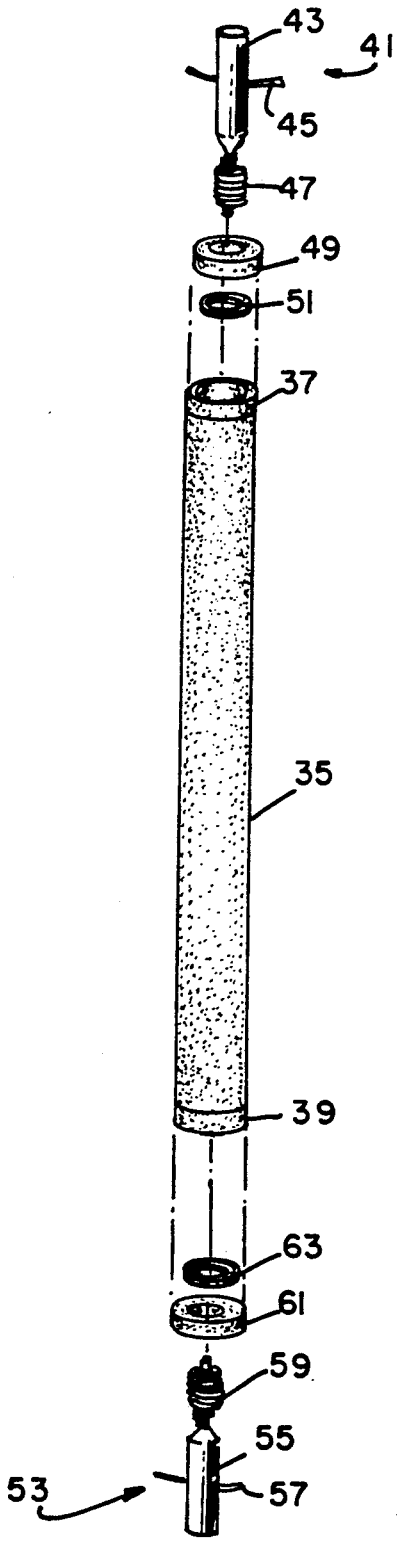
FIG. 2 is an exploded isometric view of the arc tube of the discharge lamp of FIG. 1.
Figure 3:
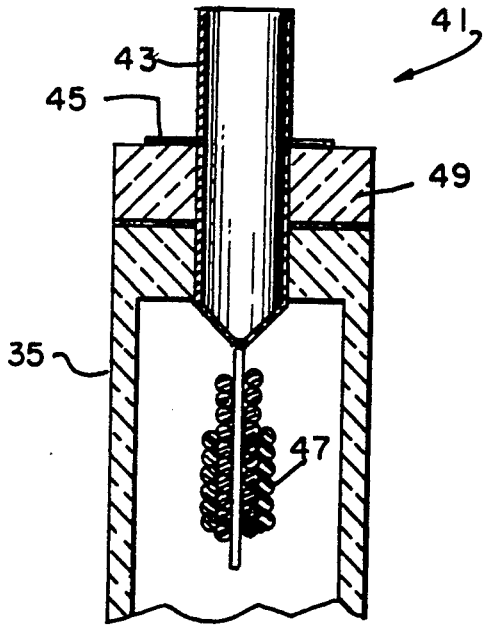
FIG. 3 is an enlarged section of one end of the arc tube of FIG. 2.

As to fabrication of the above-mentioned arc tube 27, reference is made to the exploded view of FIG. 2 and enlarged view of FIG. 3. A ceramic envelope 35 of a material, such as a polycrystalline alumina for example, has an apertured end of reduced diameter 37 and 39 affixed to either end thereof. A first electrode member 41 has a support portion 43 with outwardly extending fins 45 and an attached electrode portion 47.

An apertured ceramic wafer 49 is telescoped over the electrode portion 47 and placed in contact with the outwardly extending fins 45. Then, an apertured glass frit wafer 51 is telescoped over the electrode portion 47 and into contact with the apertured ceramic wafer 49. Thereafter, the electrode portion 47 of the first electrode member 41 is inserted into the ceramic envelope by way of the apertured end 37. Heat is applied to the one end of the envelope 35, apertured wafer 37, glass frit wafer 51, apertured ceramic wafer 49 and electrode member 41 in an amount sufficient to hermetically seal the electrode member 41 into the ceramic envelope 35.

The ceramic envelope 35 having a hermetically sealed end portion is usually transferred to an inert atmosphere, such as a well-known inert atmosphere glove box. Therein, a sodium-mercury amalgam is introduced into the envelope 35 by way of the opposite or unsealed end of the envelope 35. Moreover, the mercury may be in the form of a metal alloy or mercuric oxide decomposable to provide the desired mercury vapor.

Also, an oxygen-absorbing getter is introduced into the ceramic envelope 35 by way of the opposite or unsealed end thereof. The getter is a metal alloy which is preferably selected from the metal group consisting of aluminum, titanium, scandium, hafnium, cerium, lanthanum, thorium, yttrium and zirconium. Also, other rare earth or actinide metals are applicable so long as the oxygen-absorbing capabilities are present.

Following, a second electrode member 53 having a support portion 55 with outwardly extending fins 57 and an attached electrode portion 59 has an apertured ceramic 61 telescoped over the electrode portion 59 and into contact with the outwardly extending fins 57. An apertured frit wafer 63 is also telescoped over the electrode portion 59 and contacts the apertured ceramic 61. The electrode portion 59 of the second electrode member 53 is placed in the other end of the ceramic tube 35 with the frit wafer 61 in loose contact therewith.

A noble or rare gas such as xenon is introduced into the ceramic envelope 35 by way of the unsealed end whereat the second electrode member 53 is loosely located. Preferably, the noble or rare gas is employed to flush the ceramic prior to being introduced therein at a given desired pressure. Thereafter, the second electrode member 53 is frit sealed into the opposite end of the ceramic envelope 35 to provide a desired arc tube 27. Moreover, the arc tube 27 is supported within an evacuated glass envelope, in a manner well known in the art to provide an unsaturated vapor high pressure sodium lamp.

While there has been shown and described what is at present considered the preferred embodiments of the invention, it will be obvious to those skilled in the art that various changes and modifications may be made therein without departing from the invention as defined by the appended claims.

What is claimed is:

1. A process for fabricating an arc tube of an unsaturated vapor pressure type high pressure sodium lamp comprising the steps of:

sealing a first electrode into one end of a tubular envelope;

depositing a dosing of a sodium-mercury amalgam and an oxygen-absorbing getter into said tubular envelope;

flushing said tubular envelope with a noble gas;

filling said flushed tubular envelope with said noble gas at a pressure substantially equal to the desired finished arc tube pressure; and sealing a second electrode into an opposite end of said tubular envelope whereby said amalgam is decomposed within said envelope to provide sodium and mercury for lamp operation and said getter absorbs oxygen impurities to prevent sodium loss during said lamp operation.

2. The arc tube fabricating process of claim 1 wherein said sealing of said first and second electrodes into the ends of said tubular envelope include the steps of:

telescoping and supporting an apertured ceramic on an electrode member;

telescoping a ring of glass frit material over said electrode member and into contact with said ceramic;

locating said electrode within said tubular envelope and said ring of glass frit in contact with the end of said tubular envelope; and applying heat to said ring of glass frit in an amount sufficient to melt said ring of glass frit and seal said ceramic to said electrode member and to said envelope.

3. The arc tube fabricating process of claim 1 wherein said tubular envelope is in the form of a polycrystalline alumina envelope.

4. The arc tube fabricating process of claim 1 wherein said oxygen-absorbing getter is in the form of a metal or metal alloy.

5. The arc tube fabricating process of claim 1 wherein said tubular arc tube having a tubular electrode sealed into one end thereof is transferred to an inert atmosphere glove box prior to said depositing of said dose therein.

6. In the manufacture of unsaturated vapor type high pressure sodium lamps having an arc tube supported within an evacuated glass envelope and affixed to a base member, an arc tube fabricating process comprising the steps of:

glass frit sealing an electrode into one end of a tubular ceramic envelope;

transferring said envelope into an inert atmosphere;

introducing a sodium-mercury amalgam and an oxygen-absorbing getter into said tubular ceramic envelope;

introducing a noble gas into said tubular ceramic envelope; and glass frit sealing an electrode into the other end of said tubular ceramic envelope whereby amalgam decomposition and oxygen absorption is effected within said ceramic tubular envelope.

7. The arc tube fabricating process of claim 6 wherein said oxygen-absorbing getter includes a metal alloy selected from the group of metals consisting of aluminum, titanium, scandium, hafnium, cerium, lanthanum, thorium, yttrium and zirconium.

* * * * *